US006609626B2

(12) United States Patent
Young et al.

(10) Patent No.: US 6,609,626 B2
(45) Date of Patent: Aug. 26, 2003

(54) ARTICLE HOLDING DEVICE FOR A COOLER

(76) Inventors: Gary Young, 12478 S. Elm Meadows Rd., Riverton, UT (US) 84065; Jim Young, 402 W. 300 North, Manti, UT (US) 84642; Ray Young, 2715 W. 12075 South, Riverton, UT (US) 84065; Danny Young, 536 Julep Dr., Murray, UT (US) 84107

( * ) Notice: Subject to any disclaimer, the term of this patent is extended or adjusted under 35 U.S.C. 154(b) by 48 days.

(21) Appl. No.: 09/944,023

(22) Filed: Aug. 31, 2001

(65) Prior Publication Data

US 2003/0042266 A1 Mar. 6, 2003

(51) Int. Cl.[7] ..... B65D 23/08

(52) U.S. Cl. ..... 220/592.03; 220/739; 220/915.2; 150/154

(58) Field of Search ..... 220/694, 23.83, 220/735, 739, 915.2, 592.03; 190/102; 150/154

(56) References Cited

U.S. PATENT DOCUMENTS 5,407,218 A 4/1995 Jackson
5,511,655 A * 4/1996 Porter ..... 206/83.5
5,658,314 A 8/1997 Scheffer et al.
5,772,066 A 6/1998 Reynolds
5,797,528 A 8/1998 Mcduffie
D400,054 S 10/1998 Emery
5,904,243 A * 5/1999 Porter ..... 206/83.5
5,975,334 A 11/1999 Mayo
6,036,047 A * 3/2000 Dobbie ..... 220/592.03
6,145,696 A * 11/2000 Duncan ..... 220/739
6,189,700 B1 * 2/2001 Packrall et al. ..... 206/736

* cited by examiner

*Primary Examiner*—Joseph M. Moy

(57) ABSTRACT

An article holding device for a cooler for removably positioning on a cooler for transportation items with the cooler. The article holding device for a cooler includes a top panel having a peripheral edge. A peripheral panel is attached to and extends along the peripheral edge such that a front panel, a back panel, and a pair of side panels are defined. The top panel is positionable on a cover of a cooler such that the peripheral panel generally covers walls of the cooler. A plurality of pockets is attached to the peripheral panel. Each of the pockets has an opening facing upwardly toward the top panel.

5 Claims, 2 Drawing Sheets

ARTICLE HOLDING DEVICE FOR A COOLER

BACKGROUND OF THE INVENTION

1. Field of the Invention

The present invention relates to tote devices and more particularly pertains to a new article holding device for a cooler for removably positioning on a cooler for transportation items with the cooler.

2. Description of the Prior Art

The use of tote devices is known in the prior art. More specifically, tote devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,772,066; 5,407,218; 5,797,528; 5,975,334; 5,658,314; and U.S. Des. No. 400,054.

While these devices fulfill their respective, particular objectives and requirements, the aforementioned patents do not disclose a new article holding device for a cooler. The inventive device includes a top panel having a peripheral edge. A peripheral panel is attached to and extends along the peripheral edge such that a front panel, a back panel, and a pair of side panels are defined. The top panel is positionable on a cover of a cooler such that the peripheral panel generally covers walls of the cooler. A plurality of pockets is attached to the peripheral panel. Each of the pockets has an opening facing upwardly toward the top panel.

In these respects, the article holding device for a cooler according to the present invention substantially departs from the conventional concepts and designs of the prior art, and in so doing provides an apparatus primarily developed for the purpose of removably positioning on a cooler for transportation items with the cooler.

SUMMARY OF THE INVENTION

In view of the foregoing disadvantages inherent in the known types of tote devices now present in the prior art, the present invention provides a new article holding device for a cooler construction wherein the same can be utilized for removably positioning on a cooler for transportation items with the cooler.

The general purpose of the present invention, which will be described subsequently in greater detail, is to provide a new article holding device for a cooler apparatus and method which has many of the advantages of the tote devices mentioned heretofore and many novel features that result in a new article holding device for a cooler which is not anticipated, rendered obvious, suggested, or even implied by any of the prior art tote devices, either alone or in any combination thereof.

To attain this, the present invention generally comprises a top panel having a peripheral edge. A peripheral panel is attached to and extends along the peripheral edge such that a front panel, a back panel, and a pair of side panels are defined. The top panel is positionable on a cover of a cooler such that the peripheral panel generally covers walls of the cooler. A plurality of pockets is attached to the peripheral panel. Each of the pockets has an opening facing upwardly toward the top panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new article holding device for a cooler apparatus and method which has many of the advantages of the tote devices mentioned heretofore and many novel features that result in a new article holding device for a cooler which is not anticipated, rendered obvious, suggested, or even implied by any of the prior art tote devices, either alone or in any combination thereof.

It is another object of the present invention to provide a new article holding device for a cooler which may be easily and efficiently manufactured and marketed.

It is a further object of the present invention to provide a new article holding device for a cooler which is of a durable and reliable construction.

An even further object of the present invention is to provide a new article holding device for a cooler which is susceptible of a low cost of manufacture with regard to both materials and labor, and which accordingly is then susceptible of low prices of sale to the consuming public, thereby making such article holding device for a cooler economically available to the buying public.

Still yet another object of the present invention is to provide a new article holding device for a cooler which provides in the apparatuses and methods of the prior art some of the advantages thereof, while simultaneously overcoming some of the disadvantages normally associated therewith.

Still another object of the present invention is to provide a new article holding device for a cooler for removably positioning on a cooler for transportation items with the cooler.

Yet another object of the present invention is to provide a new article holding device for a cooler which includes a top panel having a peripheral edge. A peripheral panel is attached to and extends along the peripheral edge such that a front panel, a back panel, and a pair of side panels are defined. The top panel is positionable on a cover of a cooler such that the peripheral panel generally covers walls of the cooler. A plurality of pockets is attached to the peripheral panel. Each of the pockets has an opening facing upwardly toward the top panel.

Still yet another object of the present invention is to provide a new article holding device for a cooler that is removably positionable on and retrofitted to coolers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
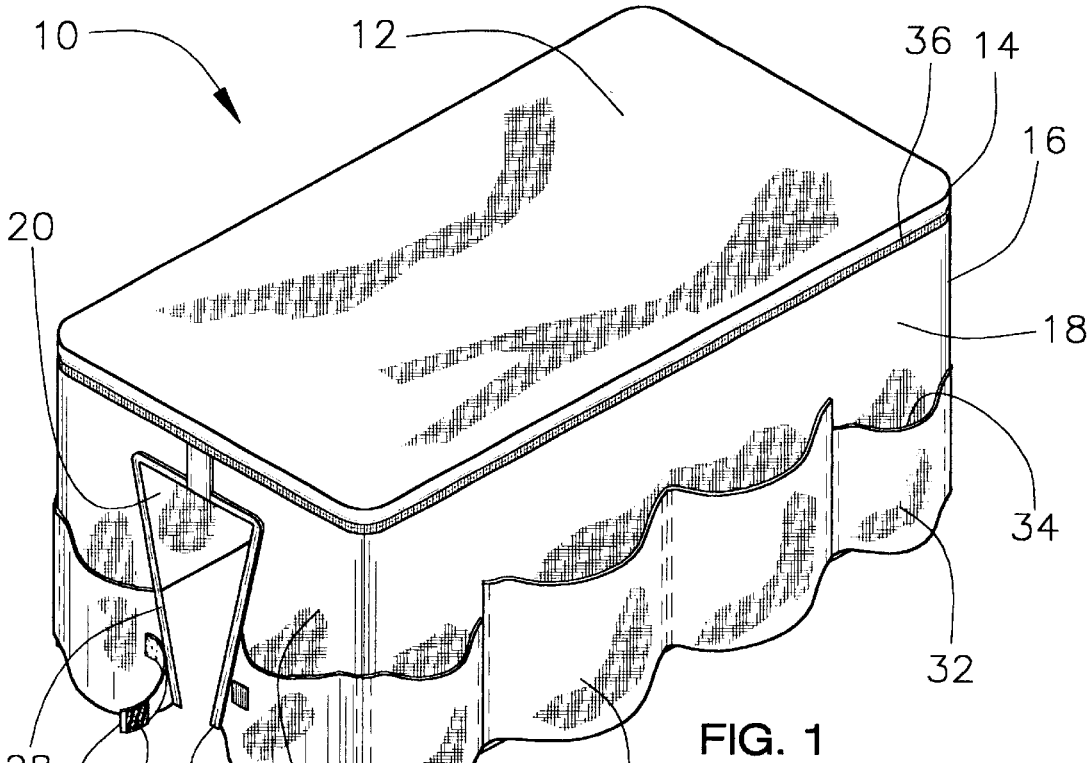
FIG. 1 is a schematic perspective view of a new article holding device for a cooler according to the present invention.
Figure 2:
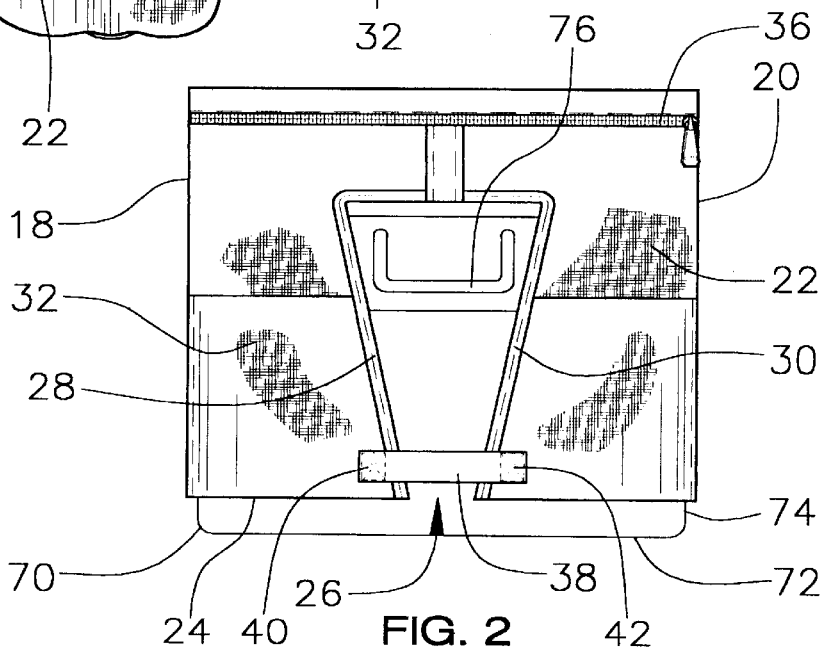
FIG. 2 is a schematic side view of the present invention.
Figure 3:
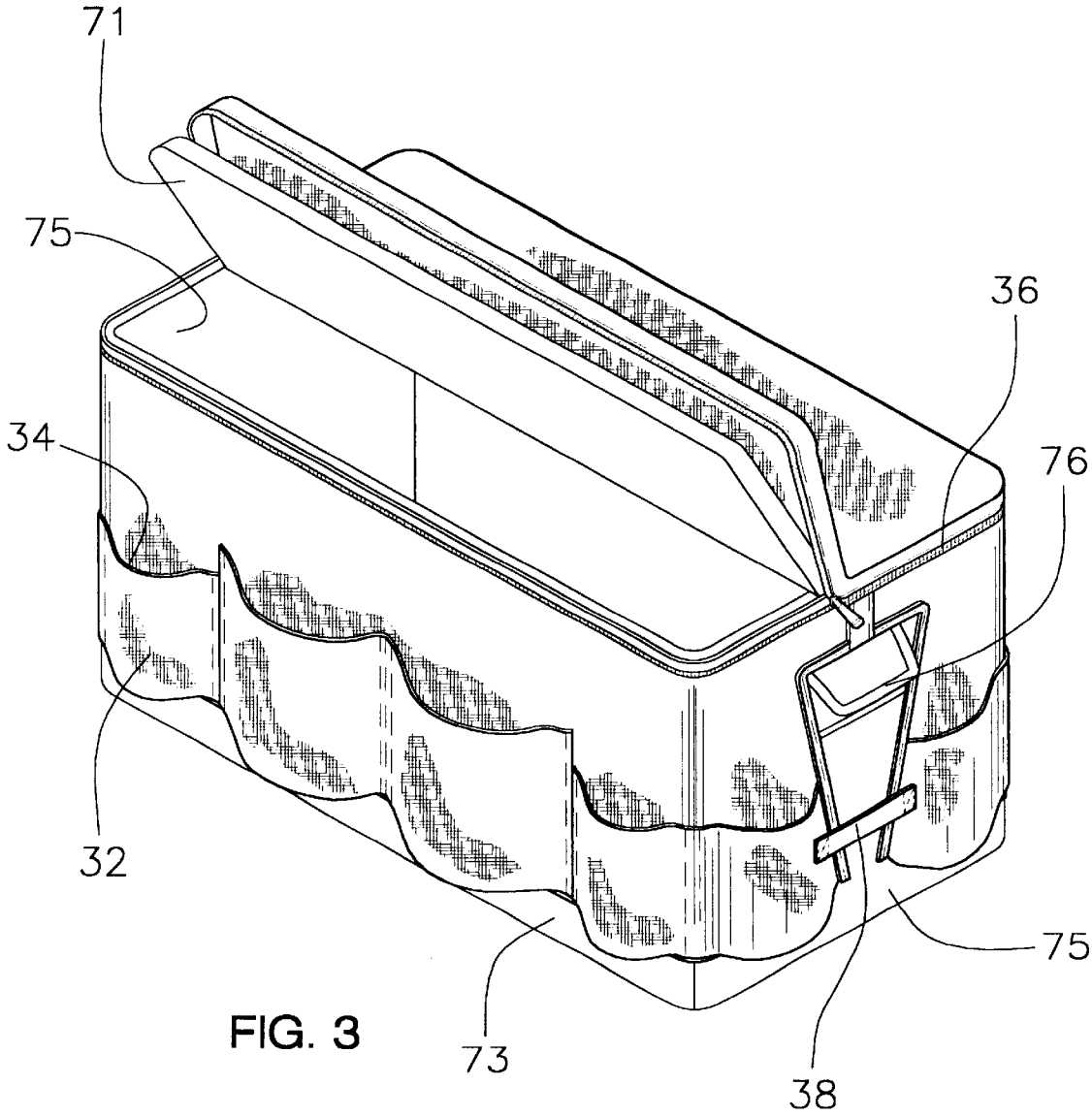
FIG. 3 is a schematic perspective view of the present invention.

With reference now to the drawings, and in particular to FIGS. 1 through 3 thereof, a new article holding device for a cooler embodying the principles and concepts of the present invention and generally designated by the reference numeral 10 will be described.

As best illustrated in FIGS. 1 through 3, the article holding device for a cooler 10 generally comprises a device for a conventional cooler 70 having a cover 71, a bottom wall 72, a front wall 73, a back wall 74 and a pair of side walls 75. Each of a pair of handles 76 is conventionally attached to one of the side walls.

The device 10 includes a top panel 12 having a peripheral edge 14. A peripheral panel 16 is attached to and extends along the peripheral edge 14 such that a front panel 18, a back panel 20, and a pair of side panels 22 are defined. The peripheral panel 16 has a bottom edge 24. Each of the side panels 22 has a channel 26 therein extending upwardly through bottom edge 24. Each of the channels 26 has a generally triangular shape such that the channels 26 widen toward the top panel 12. Each of the channels 26 has a first side edge 28 and a second side edge 30 generally facing each other. The top panel 12 is positionable on the cover 71 such that the peripheral panel 16 generally covers the walls 73–75 of the cooler 70 and the handles 76 are positioned in one of the channels 26.

Each of a plurality of pockets 32 is attached to the peripheral panel 16. The pockets 32 are positioned around and are adjacent to the bottom edge 24 of the peripheral panel 16. Each of the pockets 32 has an opening 34 facing upwardly toward the top panel 12.

A zipper means 36 is attached to and extends around the peripheral edge 14 of the top panel 12 for selectively removing the top panel 12 from the peripheral panel 16.

Each of a pair straps 38 has a first end 40 and a second end 42. Each of the first ends 40 is attached to one of the first edges 28 of the channels 26. Each of a pair of securing means 44 is attached to one of the second edges 30 of the channels 26 for removably attaching each of the second ends 42 of the straps 38 to the respective one of the second edges 30. The securing means 44 preferably comprises a hook and loop securing means. The straps 38 are each positioned generally adjacent to the bottom edge 24 of the peripheral panel 16.

In use, the device 10 is positioned on the cooler 70 as described above. The channels 26 are positioned for allowing a user to reach the handles 76 of the cooler 70. The zipper means 36 removes the top panel 12 from the peripheral panel 16 for opening the cooler 70 as shown in FIG. 3. Articles may be positioned in the pockets 32 so that user needs only carry only one unit.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A cooler mounted article storing device for removably positioning on a cooler, the cooler having a cover, a bottom wall, a front wall, a back wall and a pair of side walls, each of a pair of handles being attached to one of the side walls, said device comprising:

a top panel having a peripheral edge, a peripheral panel being attached to and extending along said peripheral edge such that a front panel, a back panel, and a pair of side panels are defined, said peripheral panel having a bottom edge, said top panel being positionable on the cover such that said peripheral panel generally covers the walls of the cooler;

a plurality of pockets being attached to said peripheral panel, each of said pockets having an opening facing upwardly toward said top panel;

wherein each of said side panels having a channel therein extending upwardly through bottom edge for receiving one of the handles of the cooler; and wherein each of said channels has a generally triangular shape such that said channels widen toward said top panel.

2. The cooler mounted article storing device as in claim 1, wherein each of said channels has a first side edge and a second side edge generally facing each other, a pair straps each having a first end and a second end, each of said first ends being attached to one of said first edges of said channels, each of a pair of securing means being attached to one of said second edges of said channels for removably attaching each of said second ends of said straps to respective one of said second edges, each of said straps being positioned generally adjacent to said bottom edge of said peripheral panel.

3. The cooler mounted article storing device as in claim 1, wherein said pockets are positioned around and are adjacent to said bottom edge of said peripheral panel.

4. The cooler mounted article storing device as in claim 1, further including a zipper means being attached to and extending around said peripheral edge of said top panel for selectively removing said top panel from said peripheral panel.

5. A cooler mounted article storing device for removably positioning on a cooler, the cooler having a cover, a bottom wall, a front wall, a back wall and a pair of side walls, each of a pair of handles being attached to one of the side walls, said device comprising:

a top panel having a peripheral edge, a peripheral panel being attached to and extending along said peripheral edge such that a front panel, a back panel, and a pair of side panels are defined, said peripheral panel having a bottom edge, each of said side panels having a channel therein extending upwardly through bottom edge, each of said channels having a generally triangular shape such that said channels widen toward said top panel, each of said channels having a first side edge and a second side edge generally facing each other, said top panel being positionable on the cover such that said peripheral panel generally covers the walls of the cooler and the handles are positioned in one of said channels;

a plurality of pockets being attached to said peripheral panel, said pockets being positioned around and being adjacent to said bottom edge of said peripheral panel, each of said pockets having an opening facing upwardly toward said top panel;

a zipper means being attached to and extending around said peripheral edge of said top panel for selectively removing said top panel from said peripheral panel; and a pair straps each having a first end and a second end, each of said first ends being attached to one of said first edges of said channels, each of a pair of securing means being attached to one of said second edges of said channels for removably attaching each of said second ends of said straps to respective one of said second edges, each of said straps being positioned generally adjacent to said bottom edge of said peripheral panel.

* * * * *